US005361700A

United States Patent [19]

Carbone

[11] Patent Number: 5,361,700

[45] Date of Patent: Nov. 8, 1994

[54] BALL-FIRING CARTRIDGE AND METHOD

[75] Inventor: Alfred V. Carbone, Hopkinton, N.H.

[73] Assignee: Academy of Applied Science, Concord, N.H. ; a part interest

[21] Appl. No.: 165,776

[22] Filed: Dec. 10, 1993

[51] Int. Cl.[5] ..... F42B 5/02; F42B 14/06

[52] U.S. Cl. ..... 102/439; 102/444; 102/502; 102/513; 102/520; 102/529; 102/532

[58] Field of Search ..... 102/430, 439, 448–463, 102/444, 446, 447, 502, 513, 520, 521, 522, 529, 532

[56] References Cited

U.S. PATENT DOCUMENTS

| | | | |
|---|---|---|---|
| 111,377 | 1/1871 | Paine | 102/449 |
| 1,864,916 | 6/1932 | Gachassin-Lafite | 102/449 |
| 3,503,332 | 3/1970 | Gregorio | 102/450 |
| 3,577,924 | 3/1971 | Findlay | 102/448 |
| 3,721,194 | 3/1973 | Weston, Jr. | 102/449 |
| 3,730,095 | 5/1973 | Lage | 102/450 |
| 3,791,303 | 2/1974 | Sweeney | 102/502 |
| 4,290,365 | 9/1981 | Dreyer | 102/449 |
| 4,947,752 | 8/1990 | Richert | 102/439 |

FOREIGN PATENT DOCUMENTS

| | | | |
|---|---|---|---|
| 4016826 | 11/1991 | Germany | 102/449 |
| 1607552 | 4/1992 | Russian Federation | 102/449 |
| 123501 | 2/1919 | United Kingdom | 102/522 |

*Primary Examiner*—Harold J. Tudor
*Attorney, Agent, or Firm*—Rines & Rines

[57] ABSTRACT

A novel cartridge for conventional shot gun and other weapons, suitable for training and other applications, and containing a thin-walled ball encapsulating a substance to be ejected upon the ball hitting the target, provided with a folded fan enclosure for the ball and its holder within the cartridge which, upon expulsion of the ball-holder-fan unit upon firing, causes the ball to separate and continue to the target, while the folded fan segments spring open in free flight into an air-resistant disc and then pinwheel with the holder harmlessly to the ground within a short distance of the gun.

5 Claims, 3 Drawing Sheets

BALL-FIRING CARTRIDGE AND METHOD

Figure 1:
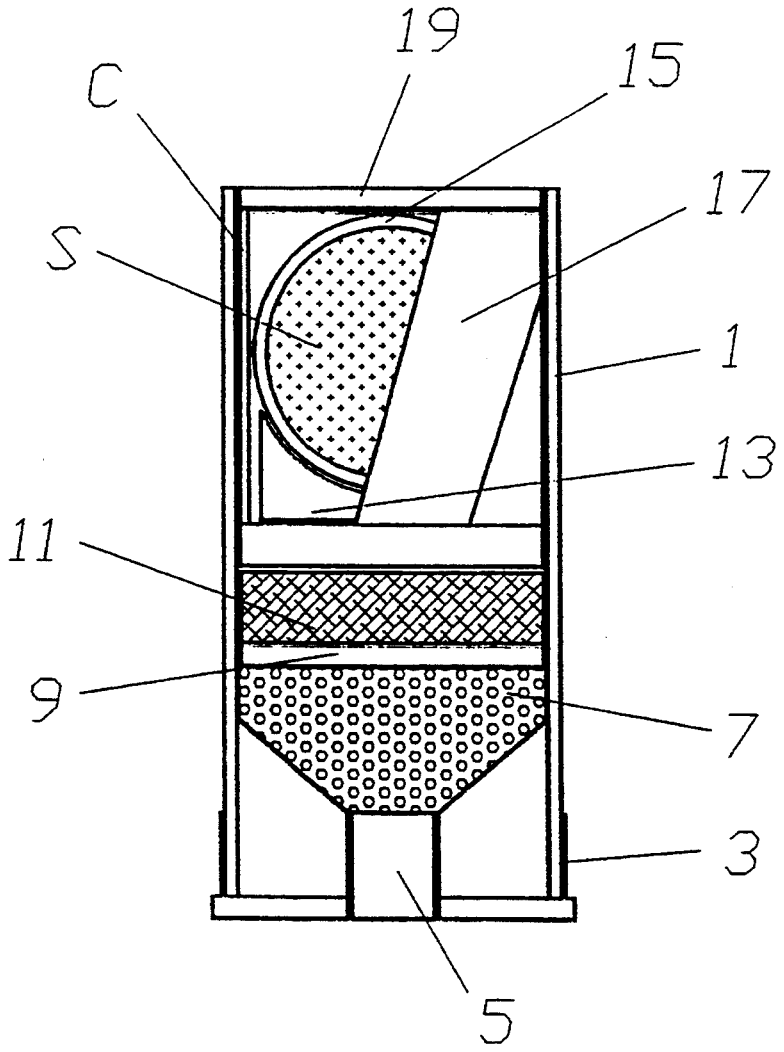

The present invention relates to gun cartridges and the like, and particularly, though not exclusively, to shot gun cartridges, and to projectiles fired therefrom that are in the form of thin-walled balls containing substances that are ejected upon impact of the fired ball, such as marking dyes, or paints or irritants, such as pepper or teargas or the like.

BACKGROUND

Gun cartridges containing paint and other fluid-containing ball projectiles have been widely used for target practice and for games, as described, for example, in magazines entitled "Action Pursuit Games", "Pursuit Games", "Paint Ball Pursuit", "Paintball Sports". Such devices are particularly useful for training applications by police, the military, SWAT teams and other law enforcement agencies for such purposes as riot and crowd control, rapid marking of objects, animals, trees, people and the like, and for precise delivery of the desired substance contained within the ball.

Special training guns are often required to accomodate the cartridge constructions, as distinguished from use in the actual weapons customarily employed by police, military or others for which these special marking cartridges are not adapted.

Prior ball cartridges, moreover, introduce the danger of injury to the party at which such are fired, by virtue of the propulsion out of the cartridge of the generally plastic or other ball-holding insert that often hits and hurts such parties.

Underlying the present invention is the modification of the ball - carrying cartridge construction to enable its use in such actual weapons, such as, for example, conventional shot gun type weapons, instead of special training weapons, including compressed air or gas - tank expulsion guns, and that insures the harmless dropping of the ball insert to the ground within a short distance of the gun. This also enables ready distinction of the ball-cartridges from live ammunition, so that mistakes are unlikely.

OBJECTS OF INVENTION

An object of the present invention, accordingly, is to provide a new and improved substance - containing ball-firing cartridge and the like and method of operation thereof, that are not subject to the above limitations but that, to the contrary, enable training or use with actual not training, weapons, and that prevent damage to the target by being struck by the ball-holding insert, and that further enable clear distinguishment from the appearance of live ammunition.

Other and further objects will be explained hereinafter and are more fully delineated in the appended claims.

SUMMARY

In summary, however, from one of its important aspects, the invention embraces a substance-containing, thin-wall ball projectile cartridge having, in combination with a base powder charge, in seriatim within the cartridge housing, gas seal means, shock absorbing means, and a ball-holding cup mounted upon the shock absorbing means and contained together with the ball within, and enveloped by, a thin folded segmented fan adapted, upon the firing of the charge and the resulting explosion of the ball-cup-fan unit, for the folded fan segments to open promptly into a flat air-resistant disc.

Preferred operational methods and best mode designs are later explained.

DRAWINGS

Figure 2:
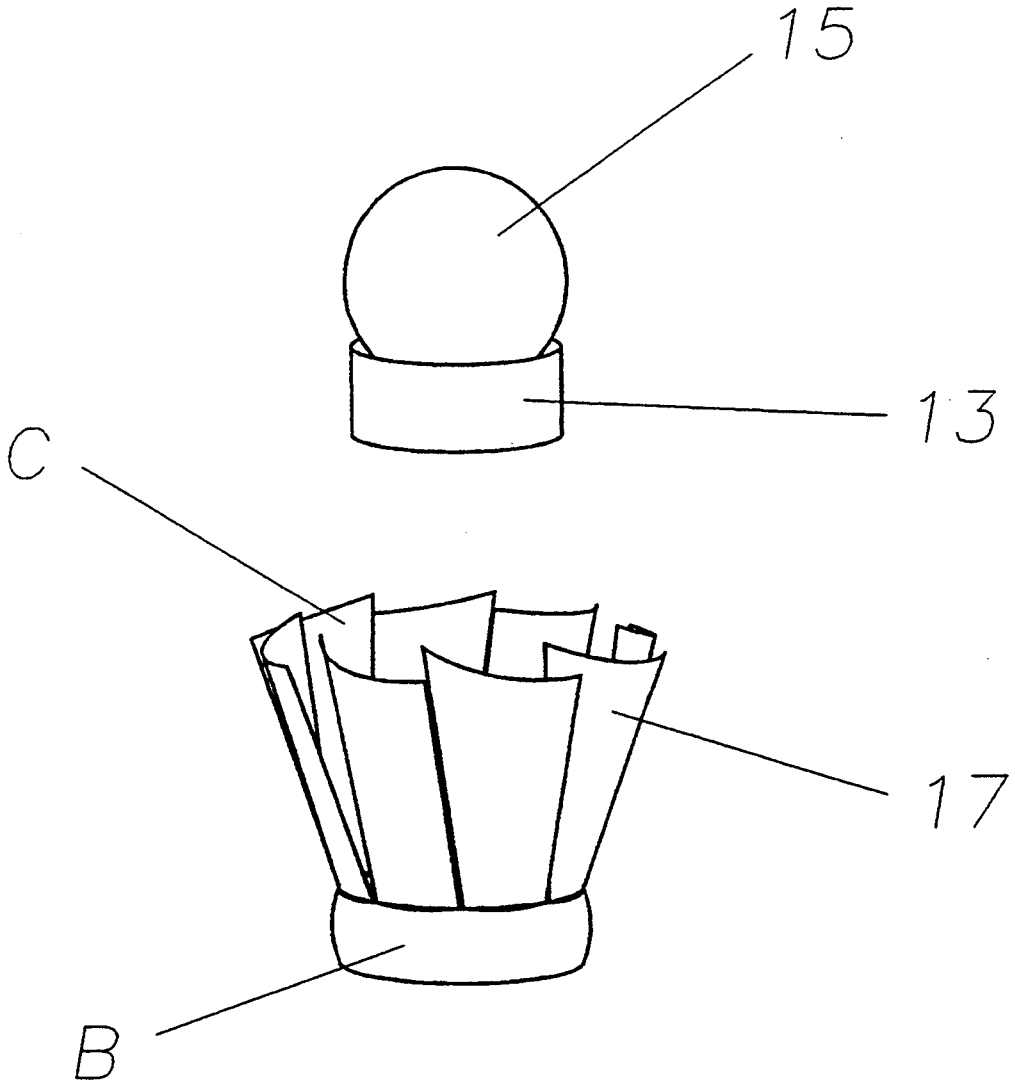
Figure 3:
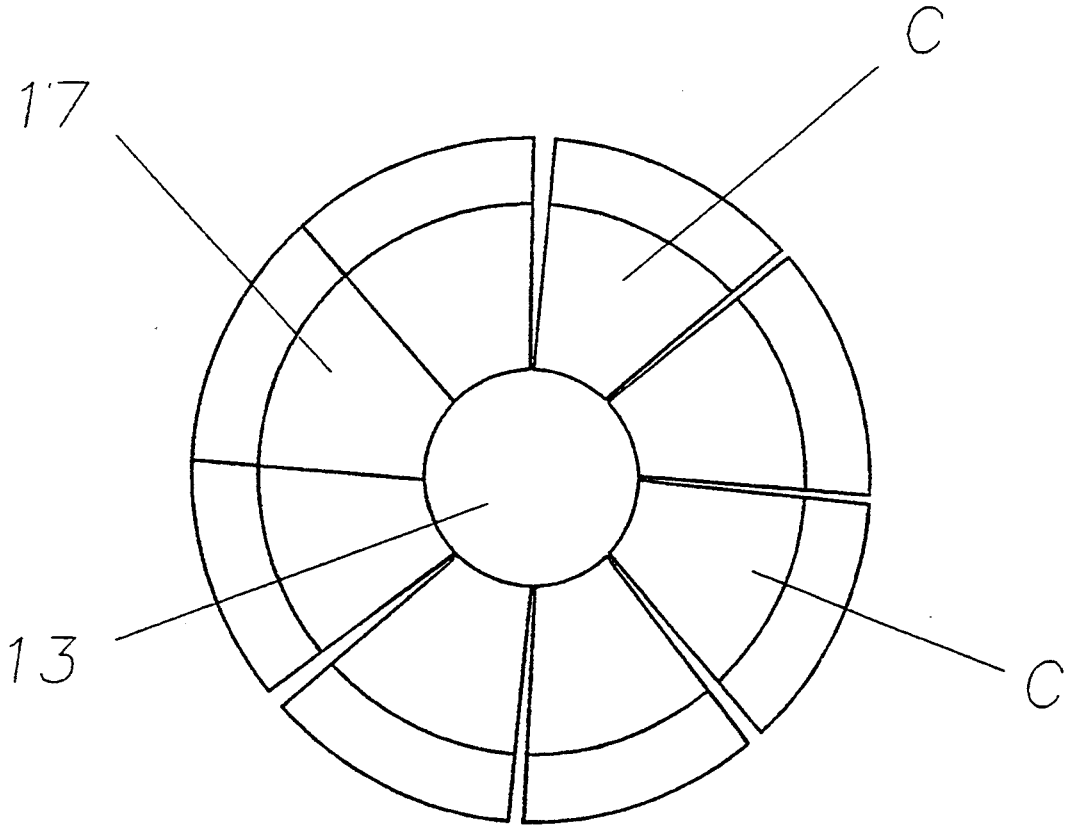

The invention will now be explained in connection with the accompanying drawing FIG. 1 of which is a longitudinal cross-section of a cartridge constructed in accordance with a preferred embodiment of the invention;

FIG. 2 is a dis-assembled isometric view of the ball-carrying insert showing further details; and FIG. 3 is a photograph showing the actual performance of the invention in practice.

For purposes of illustration, the invention is illustrated as applied to a shot-gun type cartridge of standard shot gun hull or casing diameter (12 gauge or bore)—approximately 4/5 inch) useful with conventional shot gun weapons, and having a plastic, metal or paper outer hull housing 1 of length, however, as later discussed, considerably shorter than the conventional live pellet ammunition shot-gun cartridge (2 $\frac{5}{8}$ to 3 $\frac{1}{2}$ inches) to avoid confusion with the same. The base 3, as of brass, steel or other suitable material, as in conventional shot gun ammunition, holds the gun-firing pin and primer unit 5 that, on detonation, ignites the main powder charge 7, as is well known. Across the top of the powder charge 7, a gas-sealing disc 9 is provided in seriatim to prevent the gas generated by the ignition of the powder from passing up or along the inner walls of the cartridge. Upon the gas seal 9 is then mounted, in turn, a shock-absorbing disc 11, as of resilent foam plastic or rubber or the like, to absorb the initial shock of the firing.

In accordance with the invention, a ball-carrying plastic cup or similar cradle insert 13, receiving the thin-walled ball projectile 15 containing the substance S that is to be dispersed upon shattering impact, is mounted upon the shock absorber disc 1; but the cup is secured to the bottom of and contained within an outer folded segmented fan 17, the petal-like conical segments of which are collapsed within the cartridge. As more particularly shown in the expanded view of FIG. 2, the overlapped fan segments C rise from base B up on the inner surface of which the cup 13 rests, and when the units are assembled, FIG. 1, envelop the ball in its cup. The segmented fan 17 is preferably made of segmented paper or thin plastic with some resilience to the compression of the folding.

By the term "ball", as herein used, is meant a spherical shell or capsule containing the substance to be ejected upon the hitting of the target and the fracturing of the shell or capsule.

When the shell is fired, the unit of the fan-enveloped ball and its holding cup is expelled at high velocity. When, however, the unit is in free flight, the fan segments spring open and catch the wind, FIG. 3, acting as an air brake to provide a substantial air resistance symmetrical circular planar disc surface that causes the opened fan and cup promptly to pinwheel and drop harmlessly to the ground while the separated ball 15 continues to the target. Thus, unlike prior ball holders, as before described, there is no danger of the holder continuing toward and striking tile target.

The open end of the cartridge or hull may be closed with a serrated or segmented cover layer 19.

Prototype cartridges of this construction have been sucessfully constructed and fired for the above purposes, having a conventional or standard 12 bore diameter shot gun hull 1, of length about 1.75 inches (43.75 mm), about $\frac{2}{3}$ to $\frac{1}{2}$ the length of conventional or standard live ammunition shotgun shells (order of 2 $\frac{5}{8}$- 3 $\frac{1}{2}$ inches) length, and is considerably lighter. The ball 15 is of 17.55 mm outer diameter, made of gelatin or gelatin encapsulating material containing 2.5 cc of fluid paint for marking experiments, and having a weight of about 51 grains. The gas seal disc 9 was a disc of Mylar (or Teflon) of 0.0075 inch (6 mm) in thickness, and the shock-absorbing disc 11 was of rubber composition about the same thickness. The ball cup 13 was of styrofoam, and the segmented fan 17 was of Mylar sheet material. With a powder charge 17 of 2.5 grains, such balls effectively had a muzzle velocity of about 295 feet per second and reached targets up to distances of about 35 feet, with the expanded fan–cup falling to the ground within 8–10 feet of the gun muzzle.

Further modifications will, of course, occur to those skilled in this art, and such are considered to fall within the spirit and scope of the invention as defined in the appended claim.

What is claimed is:

1. A substance-containing thin-walled bal projectile contained within a cartridge casins having, in combination with a base powder charge, in seriatim within the cartridge casins, gas seal means, shock absorbing means, and a ball-holding cup mounted upon the shock absorbing means and contained, together with said thin-walled ball projectile, within and enveloped by and secured to a thin-walled folded segmented fan with overlapping conical fan segments adapted, upon the firing of the charge and the resulting expulsion of the ball projectile together with the cup and the fan for the folded conical fan segments to open promptly into a flat air resistant disc.

2. A cartridge as claimed in claim 1 and in which the cartridge casins is of standard shot gun shell diameter of the order of 12 gauge, but is substantially $\frac{2}{3}$–$\frac{1}{2}$ the length of standard 2 $\frac{5}{8}$–3 $\frac{1}{2}$ inch shot gun shells.

3. A cartridge as claimed in claim 2 and in which the gas seal means is a thin plastic cylindrical disc, and the shock absorbing means is a thin resilient cylindrical disc placed upon the gas seal disc.

4. A method of preventing the holder of a ball projectile contained within a gun cartridge from reaching and damaging a target toward which the ball projectile expelled upon the firing of the cartridge, that comprises, enveloping the holder containing the ball projectile secured with a folded segmented fan of overlapping conical fan segments fitted as a unit within the cartridge, whereby, upon the expulsion of the holder, the ball projectile and the fan from the gun, the ball projectile will separate and continue to the target, while the folded conical fan segments will spring open in free flight into an air-resistant disc and then pinwheel with the holder harmlessly to ground within a short distance of the gun.

5. A method as claimed in claim 4 and tn which the ball projectile is a thin-walled capsule containing a substance to be ejected upon the hitting of the target, and the resulting fracture of the thin wall.

* * * * *